US005236183A

United States Patent [19]

Curtis

[11] Patent Number: 5,236,183

[45] Date of Patent: Aug. 17, 1993

[54] VISE HAVING MODULAR JAWS

[76] Inventor: Kendall K. Curtis, 506 LaVista Rd., Pueblo, Colo. 81005

[21] Appl. No.: 742,868

[22] Filed: Aug. 9, 1991

[51] Int. Cl.[5] ..... B25B 5/10

[52] U.S. Cl. ..... 269/253; 269/242; 269/906; 269/82

[58] Field of Search ..... 269/253, 246, 241, 906, 269/237, 242, 164, 165, 258, 261, 82

[56] References Cited

U.S. PATENT DOCUMENTS 4,341,375 7/1982 Romanin ..... 269/253

4,583,724 4/1986 Huang ..... 269/253

*Primary Examiner*—Bruce M. Kisliuk

*Assistant Examiner*—E. Morgan

*Attorney, Agent, or Firm*—W. Kirk McCord

[57] ABSTRACT

A vise for holding an object, such as a snow ski or water ski, in a relatively fixed position includes first, second and third support members mountable on a support surface, a plurality of rods supported in spaced parallel relation by the support members, first and second mounting members carried on the rods and first and second jaws removably mounted on the respective first and second mounting members. One of the rods is a rotatable rods having an external threaded surface. A handle is located at one end of the rotatable rod to facilitate the rotation thereof. Each of the amounting members has a plurality of bores for accommodating the passage of the respective rods therethrough. One of the bores of each mounting member has an internal threaded surface which is complementary with the external threaded surface, such that the mounting members are movable in respective opposite directions along the rods in response to the rotation of the rotatable rod, whereby the jaws mounted on the respective mounting members are selectively engaged with and disengaged from the object. In accordance with the present invention, the mounting members are configured to accommodate a variety of jaws such that the vise is adaptable for holding objects of different sizes and shapes, such as snow skis, water skis and ski footwear.

11 Claims, 5 Drawing Sheets

VISE HAVING MODULAR JAWS

FIELD OF INVENTION

This invention relates generally to vises and in particular to a vise having modular jaws.

BACKGROUND OF THE INVENTION

Vises typically include a pair of jaws which are used to hold an object in a relatively fixed position. The jaws are moveable toward and away from one another for being selectively engaged with and disengaged from the object. A rotatable member is typically used to selectively move the jaws into and out of engagement with respect to the object and to secure the jaws in gripping engagement with the object.

Skis, including both snow skis and water skis, have top and bottom major surfaces and opposed minor side surfaces, which are made of materials, such as fiberglass, graphite or plastic. The side surfaces of a snow ski include tapered metal side edgings adjacent the bottom surface of the ski. According to prior practice, when it is desired to hold the ski in a fixed position for maintenance or repair, the ski is held in a relatively fixed position by a conventional vise with clamping elements. The clamping elements typically engage the fiberglass side surfaces and metal edgings of the ski. Pressure engagement between the side surfaces and clamping elements may result in damage to the fiberglass material and/or metal edgings. Furthermore, the side surfaces may not be sufficiently exposed to permit maintenance and repair of the side surfaces.

The need therefore exists for a vise adapted to retain a ski in a relatively fixed position by engaging the ski at a location other than on the fiberglass side surfaces and/or metal edgings of the ski. The need further exists for a vise in which the vise jaws are configured with modular components such that the vise is adaptable for holding objects of various sizes and shapes.

DESCRIPTION OF THE INVENTION

In accordance with the present invention, a vise is provided for holding an object in a relatively fixed position. The vise includes first and second mounting members, first and second jaws carried on the respective first and second mounting members and means for selectively moving the first and second mounting members and the first and second jaws into and out of engagement with the object.

In accordance with a unique feature of the invention, each of the first and second jaw members includes a first jaw member, a second jaw member pivotally attached to the corresponding first jaw member and a third jaw member attached to the corresponding second jaw member. The third jaw member of each of the first and second jaws is adapted to engage the object for holding the object in a relatively fixed position. The second and third jaw members of each jaw are pivotable with respect to the corresponding first jaw member for rotating the object between respective first and second predetermined positions. Each of the first and second jaws further includes securing means for releasably securing the corresponding second and third jaw members in respective fixed positions with respect to the corresponding first jaw member to secure the object in a predetermined fixed position.

In one embodiment, the vise is adapted to hold a ski having relatively flat top and bottom surfaces and front and back retaining members located on the top surface for engaging respective toe and heel portions of ski footwear to retain the footwear in a relatively fixed position on the ski. The third jaw member of each of the jaws is adapted to engage a corresponding one of the retaining members for holding the ski in a relatively fixed position. The ski is moveable between a first position at which the top and bottom surfaces are oriented vertically and a second position at which the top and bottom surfaces are oriented laterally. The securing means releasably secures the corresponding second and third jaw members in respective fixed positions with respect to the corresponding first jaw member to secure the ski in a predetermined fixed position.

In the preferred embodiment, the support means includes first, second and third support members in spaced apart relation, the third support member being intermediate the first and second support members. The plurality of rods includes first and second fixed rods, the rotatable rod being intermediate the first and second fixed rods. The third support member has a plurality of apertures for accommodating the passage of the respective rods through the third support member. The first support member has an opening to accommodate the passage of the rotatable rod through the first support member. One end of the rotatable rod extends beyond the first end of the vise to define an extension portion of the rotatable rod. An opposite end of the rotatable rod is coterminous with the second end of the vise. Operating means is located on the extension portion to facilitate rotation of the rotatable rod.

In the preferred embodiment, each mounting member has a plurality of bores for accommodating the passage of the respective rods through the corresponding mounting member. The plurality of bores includes a bore having an internal threaded surface which is complementary with the external threaded surface of the rotatable rod for engaging the external threaded surface such that the jaws are moveable in respective opposite directions along respective longitudinal axes of the rods in response to the rotation of the rotatable rod.

DETAILED DESCRIPTION OF THE DRAWINGS

Figure 1:
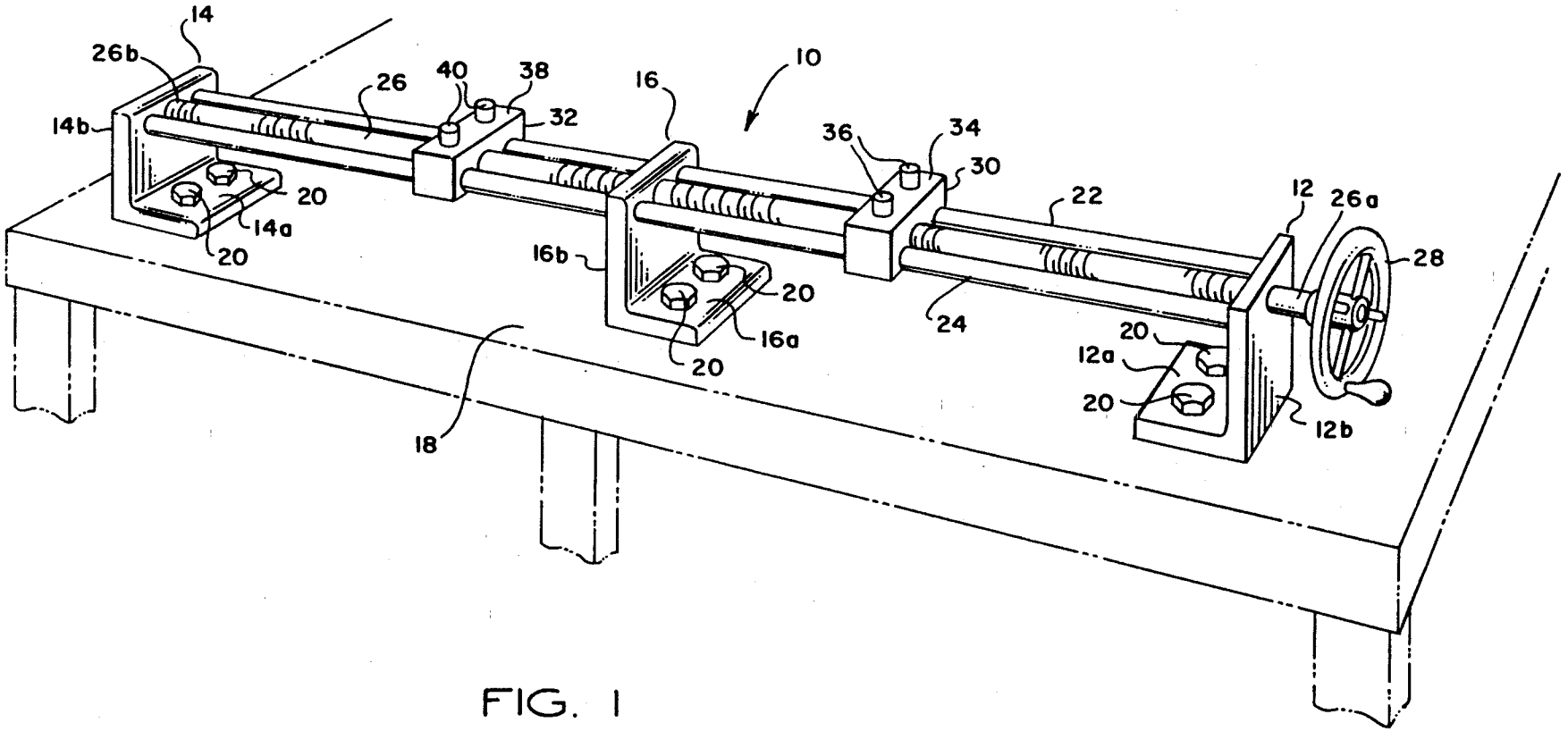
FIG. 1 is a perspective view of a vise, according to the present invention.

In the description which follows, like parts are marked throughout the specification and drawings with the same respective reference numerals. The drawings are not necessarily to scale and in some instances proportions may have been exaggerated in order to more clearly depict certain features of the invention.

Referring to FIG. 1, a vise 10 according to the present invention is comprised of respective first, second and third support members 12, 14 and 16 which are mountable on a support surface 18. First support member 12 includes a bottom portion 12*a* and an upstanding portion 12*b*. Second support member 14 includes a bottom portion 14*a* and an upstanding portion 14*b*. Third support member 16 includes a bottom portion 16*a* and an upstanding portion 16*b*. Each upstanding portion 12*b*, 14*b*, 16*b* depends upwardly from the corresponding bottom portion 12*a*, 14*a*, 16*a* such that each support member 12, 14, 16 defines an L-shaped member in cross-section. Each support member 12, 14, 16 is mounted on support surface 18 by a pair of mounting bolts 20, which extend through openings (not shown) in the corresponding bottom portion 12*a*, 14*a*, 16*a* for being embedded into support surface 18.

Three elongated rods 22, 24 and 26 are supported in space parallel relation by first, second and third support members 12, 14 and 16. Rods 22 and 24 are fixed rods, which extend between first and second support members 12 and 14. Respective upstanding portions 12*b* and 14*b* define respective first and second ends of vise 10. Upstanding portion 16*b* of third support member 16 has three apertures (not shown) for accommodating the passage of the respective rods 22, 24 and 26 through upstanding portion 16*b*.

Rod 26 has an external threaded surface and is rotatable by means of a handle 28, which is located at one end of rod 26. Upstanding portion 12*b* has an opening (not shown) to accommodate the passage of rod 26 through upstanding 12*b* such that a portion 26*a* of rod 26 extends beyond upstanding portion 12*b*. An end 26*b* of rod 26, which is opposite from the end of rod 26 at which handle 28 is located, is coterminous with upstanding portion 14*b*. Rod 26 is intermediate fixed rods 22 and 24. First and second mounting members 30 and 32 are carried on rods 22, 24 and 26. First mounting member 30 has a relatively flat top surface 34 with a pair of posts 36 projecting upwardly therefrom. Similarly, second mounting member 32 has a relatively flat top surface 38 with a pair of posts 40 projecting upwardly therefrom.

First and second mounting members 30 and 32 are adapted to removably mount vise jaws of various configuration, as will be described in greater detail hereinafter. Each mounting member 30, 32 has three bores (not shown) for accommodating the passage of respective rods 22, 24 and 26 through the corresponding mounting member 30, 32. The intermediate bore of each mounting member 30, 32 has an internal threaded surface (not shown) which is complementary with the external threaded surface of rod 26, for engaging the external threaded surface such that first and second mounting members 30 an 32 are movable in respective opposite directions along rods 22, 24 and 26 in response to the rotation of rod 26.

Figure 2A:
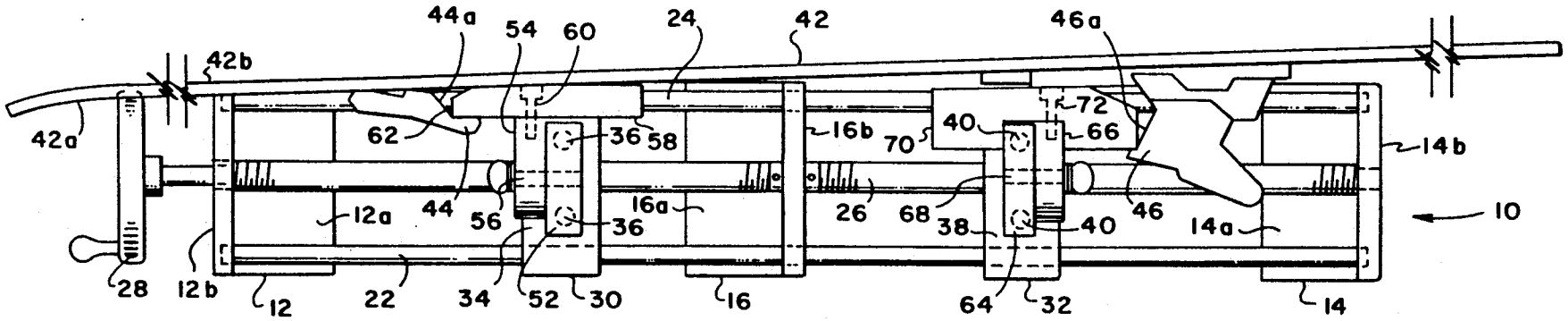
FIG. 2A and FIG. 2B are respective top plan and side elevation views of the vise of FIG. 1, equipped with a first set of jaws, illustrating the operation of the vise for retaining a snow ski in a relatively fixed position.
Figure 2B:
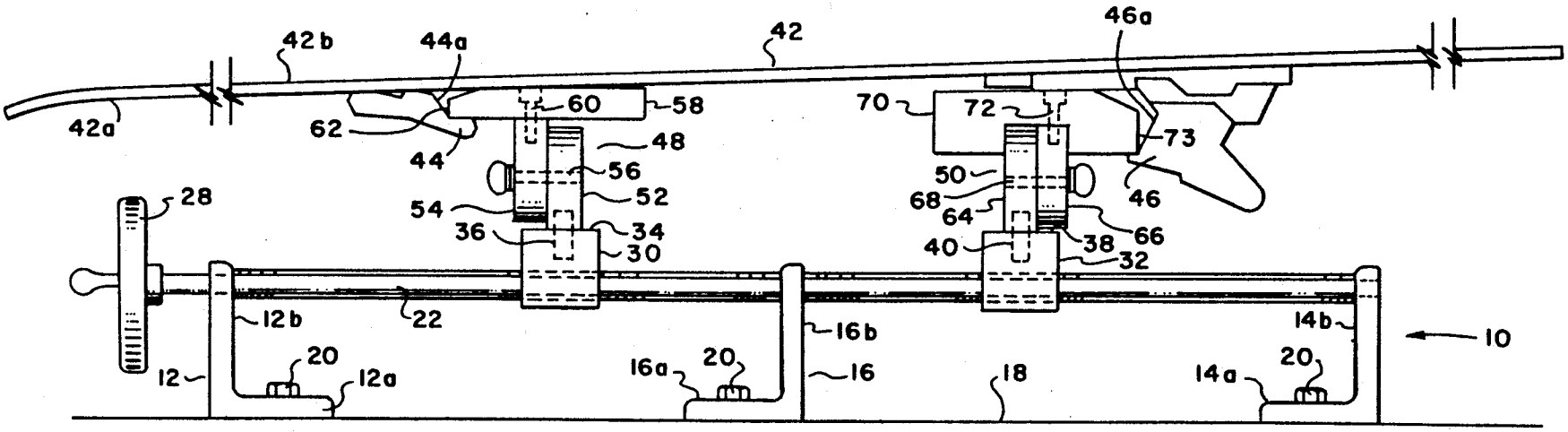

Referring now to FIG. 2A and FIG. 2B, vise 10 is equipped with a first set of jaws for retaining a snow ski 42 in a relatively fixed position. Ski 42 has relatively flat major top and bottom surfaces 42*a* and 42*b*, respectively. Top surface 42*a* has respective front and back resilient bindings 44 and 46, adapted to engage respective toe and heel portions of a skier's footwear (not shown) for retaining the footwear in a relatively fixed position on ski 42. Bindings 44 and 46 include respective engagement surfaces 44*a* and 46*a*, which are contoured to conform to the contours of the respective toe and heel portions.

Jaws 48 and 50 are removably mounted on respective first and second mounting members 30 and 32. Jaw 48 is comprised of a first jaw member 52 having a pair of bottom receptacles (not shown) for matingly receiving respective posts 36, whereby jaw 48 is removably mounted on first mounting member 30. A second jaw member 54 is pivotally attached to first jaw member 52 by a threaded attachment bolt 56. A third jaw member 58 is affixed to second jaw member 54 for co-movement therewith by two attachment bolts 60 (only one of which is shown). A leading end 62 of third jaw member 58 is adapted to contact engagement surface 44*a*. Similarly, jaw 50 includes a first jaw member 64 having a pair of bottom receptacles (not shown) for matingly receiving respective posts 40, whereby jaw 50 is removably mounted on second mounting member 32. A second jaw member 66 is pivotally attached to first jaw member 64 by means of threaded attachment bolt 68. A third jaw member 70 is affixed to second jaw member 66 by two attachment bolts 72 (only one of which is shown). A trailing end 73 of third jaw member 70 is adapted to contact engagement surface 46*a*. Engagement surfaces 44*a* and 46*a* are contoured to define respective contoured recesses. Leading end 62 is contoured to conform to the contoured recess defined by engagement surface 44*a* and trailing end 73 is contoured to conform to the contoured recess defined by engagement surface 46*a*.

In operation, first and second mounting members 30 and 32, with respective jaws 48 and 50 mounted thereon, are moved in respective opposite directions along rods 22, 24 and 26 until leading end 62 contacts engagement surface 44*a* and trailing end 73 contacts engagement surface 46*a*, as can be best seen FIG. 2B. Ski 42 is positioned as shown in FIG. 2B, with top surface 42*a* facing downwardly and top and bottom surfaces 42*a* and 42*b* substantially parallel to support surface 18. Handle 28 is then rotated in a direction tending to separate jaws 48 and 50, whereby respective third jaw members 58 and 70 are urged against respective front and back bindings 44 and 46, to hold ski 42 in a relatively fixed position. Threaded bolt 56 is tightened to secure first and second jaw members 52 and 54 together and threaded bolt 68 is tightened to secure first and second jaw members 64 and 66 together when ski 42 is in the desired orientation.

If it is desired to reorient ski 42 with top and bottom surfaces 42*a* and 42*b* facing laterally outward, as shown in FIG. 2A, threaded bolts 56 and 68 are loosened such that respective second jaw members 54 and 66 can be pivoted relative to respective first jaw members 52 and 64. Ski 42 can be oriented at any desired position between a first position at which top and bottom surfaces 42*a* and 42*b* are substantially parallel to support surface 18 with top surface 42*a* facing downwardly, as shown in FIG. 2B, and a second position at which top and bottom surfaces 42*a* and 42*b* are oriented vertically with respect to support surface 18 with top and bottom surfaces 42*a* and 42*b* facing laterally outward, as shown in FIG. 2A. To remove ski 42 from vise 10, handle 28 is rotated in an opposite direction to move mounting members 30 and 32 toward one another, thereby disengaging jaws 48 and 50 from the respective front and back bindings 44 and 46. As depicted in FIG. 2A and FIG. 2B, ski 42 is maintained in a relatively fixed position for maintenance or repair by engaging the ski bindings rather than the ski surfaces, thereby reducing the likelihood of damage to the ski surfaces, and facilitating maintenance and repair operations, such as filing of the metal side edges and repair of the fiberglass side walls.

Figure 3A:
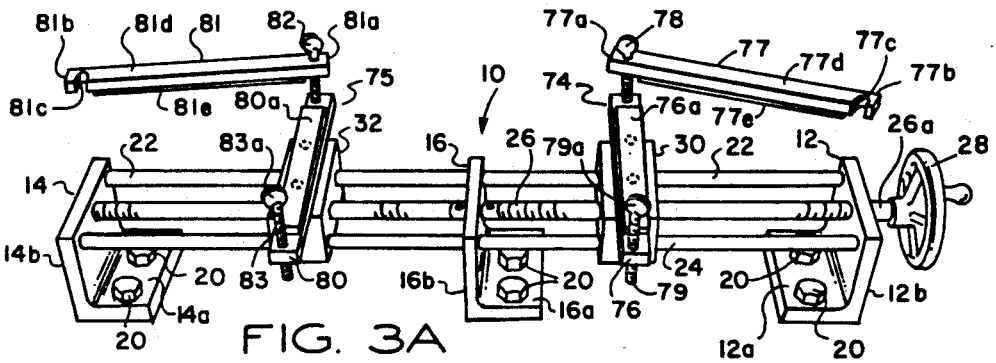
FIG. 3A and FIG. 3B are respective perspective views of the vise of FIG. 1, equipped with a second set of jaws, illustrating the operation of the vise for retaining a water ski in a relatively fixed position.
Figure 3B:
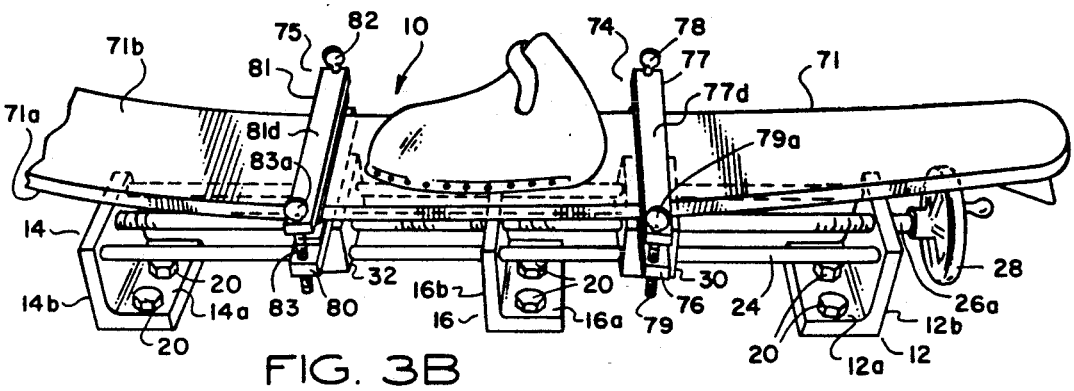

Referring to FIG. 3A and FIG. 3B, vise 10 is equipped with a second set of jaws for retaining a water ski 71 in a relatively fixed position. Jaws 74 and 75 are removably mounted on respective mounting members 30 and 32. Jaw 74 includes a bottom arm member 76 having a pair of bottom receptacles (not shown) for matingly receiving respective posts 36 to removably mount jaw 74 on first mounting member 30. A top arm member 77 is pivotally attached to bottom arm member 76 at one end 77*a* of top arm member 77 by a threaded bolt 78 and is removably attached to bottom arm member 76 at an opposite end 77*b* of top arm member 77 by threaded bolt 79. Top arm member 77 includes a notch 77*c* adjacent end 77*b*. Bottom arm member 76 has a threaded opening (not shown), which is adapted to receive threaded bolt 79. Threaded bolt 79 is received in notch 77*c* when top arm member 77 is positioned in parallel relationship with bottom arm member 76, as shown in FIG. 3B. Top arm member 77 is secured in a position parallel to bottom arm member 76 by tightening threaded bolt 79, such that head portion 79*a* of bolt 79 is secured against top surface 77*d* of top arm member 77. To release top arm member 77 for pivoting movement, threaded bolt 79 is loosened to allow notch 77*c* to be disengaged from bolt 79.

Jaw 75 includes a bottom arm member 80 having a pair of bottom receptacles (not shown) for matingly receiving respective posts 40, to removably mount jaw 75 on second mounting member 32. A top arm member 81 is pivotally attached at one end 81*a* thereof to bottom arm member 80 by a threaded bolt 82 and is removably attached at an opposite end 81*b* thereof to bottom arm member 80 by a threaded bolt 83. Top arm member 81 further includes a notch 81*c* adjacent end 81*b*, which is adapted to receive bolt 83 when top and bottom arm members 81 and 80 are in substantial parallel relationship, as can be best seen in FIG. 3B. Bottom arm member 80 has a threaded opening (not shown) through which bolt 83 extends. Top and bottom arm members 81 and 80 are secured in substantially parallel relationship by tightening head portion 83*a* of bolt 83 against top surface 81*d* of top arm member 81.

In operation, respective top arm members 77 and 81 are pivoted with respect to the corresponding bottom arm members 76 and 80, as shown in FIG. 3A, to allow water ski 71 to be positioned such that a bottom surface 71*a* of ski 71 rests on respective top surfaces 76*a* and 80*a* of first arm members 76 and 80. Top arm members 77 and 81 are then pivoted back to substantially parallel positions relative to respective bottom arm members 76 and 80 such that ski 71 is positioned between respective top ad bottom arm members 77 and 76 and between respective top and bottom arm members 81 and 80, as can be best seen in FIG. 3B. Threaded bolts 78, 79, 82 and 83 are then tightened to urge respective top arm members 77 and 81 against a top surface 71*b* of ski 71 and respective bottom arm members 76 and 81 against bottom surface 71*a*. Respective bottom surfaces 77*e* and 81*e* of top arm members 77 and 81 preferably include resilient material, to protect top surface 71*b*. Respective top surfaces 76*a* and 80*a* of bottom arm members 76 and 80 also include resilient material to protect bottom surface 71*a*. Jaws 74 and 75 are positioned as desired by operating handle 28 to move mounting members 30 and 32, with respective jaws 64 and 66 carried thereon, in respective opposite directions along rods 22, 24 and 26.

Figure 4A:
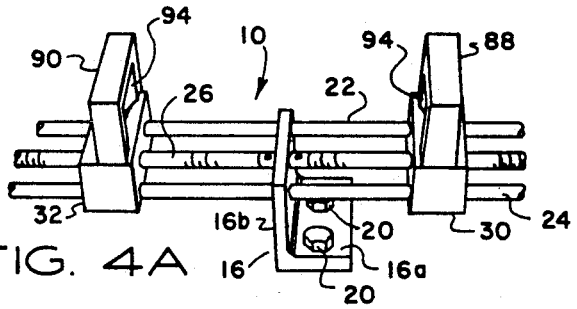
FIG. 4A and FIG. 4B are respective partial perspective and partial side elevation views of the vise of FIG. 1, equipped with a third set of jaws, illustrating the operation of the vise for retaining a snow ski boot in a relatively fixed position.
Figure 4B:
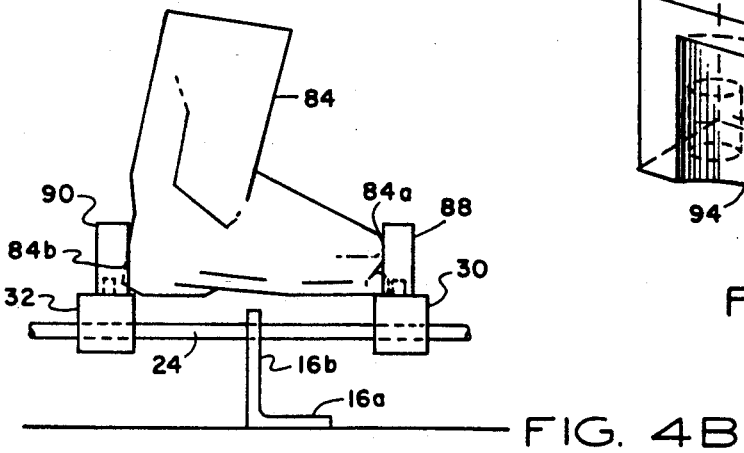
Figure 4C:
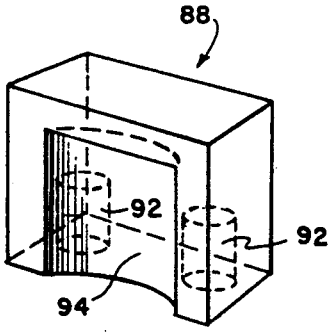
FIG. 4C is perspective view of one of the jaws of the third set of jaws shown in FIG. 4A and FIG. 4B.

Referring to FIG. 4A, FIG. 4B and FIG. 4C, vise 10 is equipped with a third set of jaws for retaining a snow ski boot 84 in a relatively fixed position. Jaws 88 and 90 are removably mounted on respective mounting members 30 and 32. A bottom portion of each jaw 88, 90 includes a pair of receptacles 92 (FIG. 4C) for receiving respective posts on the corresponding mounting member 30, 32. Each jaw 88, 90 further includes a recess 94, which is contoured to conform to the contour of either the toe portion 84*a* or the heel portion 84*b* of boot 84, as can be best seen in FIG. 4B. Boot 84 is retained in a relatively fixed position by urging jaws 88 and 90 into pressure engagement with respective toe and heel portions 84*a* and 84*b* such that toe and heel portions 84*a* and 84*b* are received within respective recesses 94.

Figure 5A:
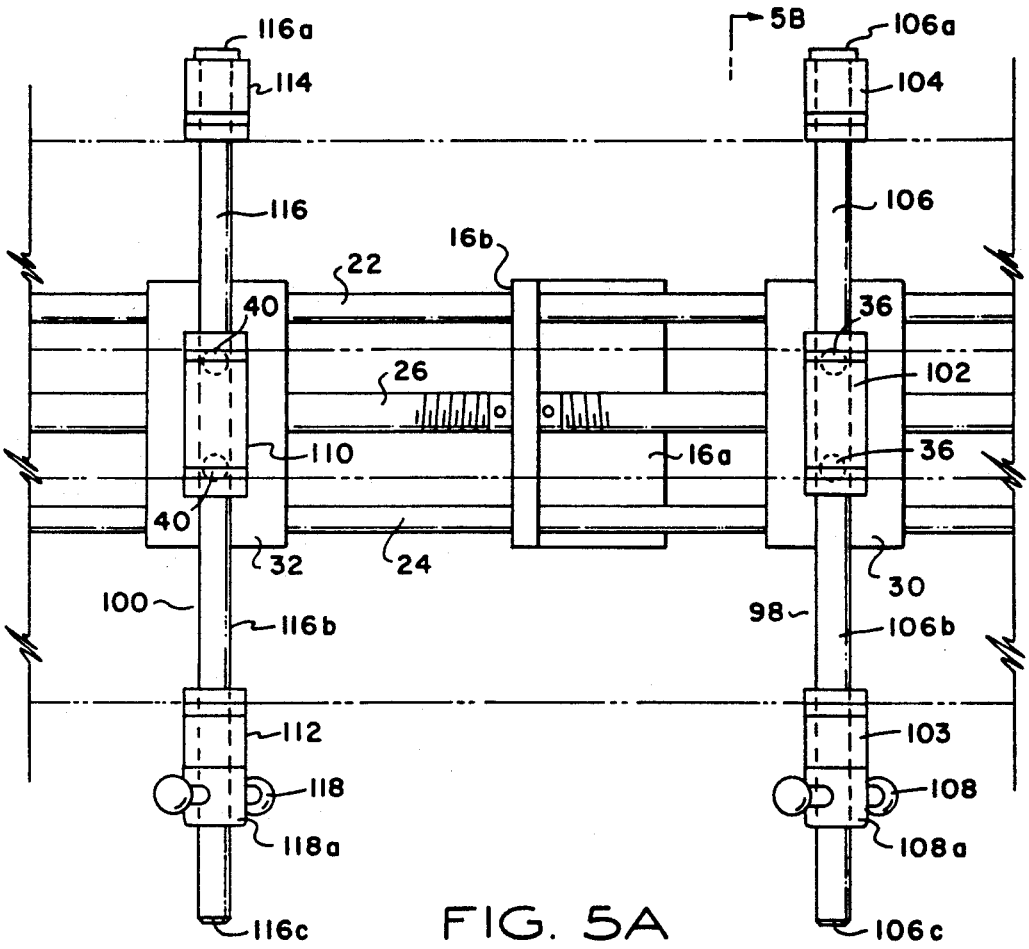
FIG. 5A is a partial top plan view of the vise of FIG. 1, equipped with a fourth set of jaws, illustrating the operation of the vise for retaining a pair of snow skis in respective relatively fixed positions.
Figure 5B:
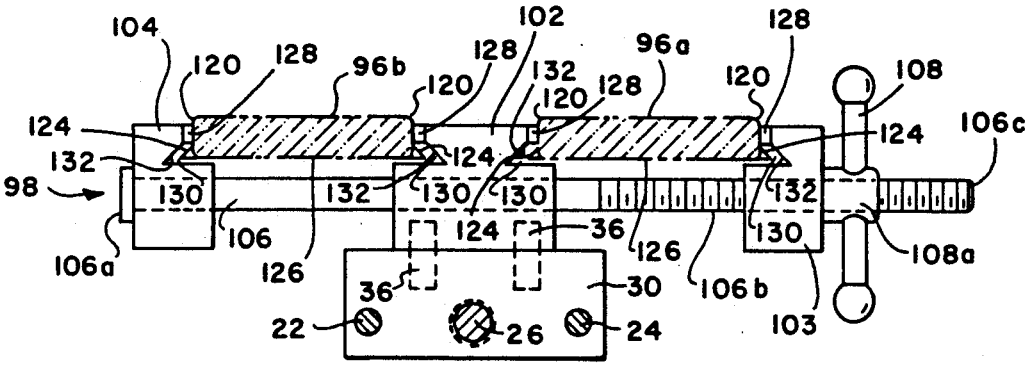
FIG. 5B is a sectional view, taken along the line 5B—5B of FIG. 5A, illustrating the engagement between one of the jaws of the fourth set of jaws and the two snow skis for retaining the two snow skis in spaced parallel relationship.

Referring to FIG. 5A and FIG. 5B, vise 10 is equipped with a fourth set of jaws for retaining snow skis 96*a* and 96*b* in a relatively fixed position. Jaws 98 and 100 are removably mounted on respective mounting members 30 and 32. Jaw 98 includes a first jaw member 102 having two bottom receptacles (not shown) for matingly receiving respective posts 36, and second and third jaw members 103 and 104, respectively. A shaft 106 extends laterally with respect to rods 22, 24 and 26. First, second and third jaw members 102, 103 and 104 have respective aligned passageways for receiving shaft 106, such that first, second and third jaw members 102, 103 and 104 are in concentric relation about shaft 106.

Third jaw member 104 is affixed to shaft 106 adjacent end 106*a* of shaft 106 for co-movement therewith. A portion 106*b* of shaft 106, located between end 106*c* of shaft 106 and first jaw member 102, has an external threaded surface, as can be best seen in FIG. 5B. A rotatable handle 108 includes a body portion 108*a*, which is in concentric relation about threaded portion 106*b*. Body portion 108*a* has an internal threaded surface which is complementary with threaded portion 106*b*. Rotation of handle 108 in a first direction rotates body portion 108*a* such that body of portion 108*a* is moved along shaft 106 toward first jaw member 102. Rotation of handle 108 in a second direction, opposite from the first direction, rotates body portion 108*a* such that body portion 108*a* is moved along shaft 106 away from first jaw member 102. Second jaw member 103 is slidable in either direction along shaft 106.

Jaw 100 has substantially the same configuration as jaw 98. Jaw 100 includes a first jaw member 110 having two bottom receptacles (not shown) for matingly receiving respective posts 40, whereby jaw 100 is removably mounted on mounting member 32. Jaw 100 further includes second and third jaw members 112 and 114 and a shaft 116 extending laterally with respect to rods 22, 24 and 26. First, second and third jaw members 110, 112 and 114 have respective aligned passageways (not shown), which are adapted to receive shaft 116 such that first, second and third jaw members 110, 112 and 114 are in concentric relation about shaft 116. Second jaw member 112 is slidable in either direction along shaft 116. Third jaw member 114 is affixed to shaft 116 adjacent end 116*a* of shaft 116 for co-movement therewith. A portion 116*b* located between an opposite end 116*c* of shaft 116 and first jaw member 112 has an external threaded surface. A rotatable handle 118 includes a body portion 118*a* in concentric relation about threaded portion 116*b*. Body portion 118*a* has an internal threaded surface which is complementary with threaded portion 116*b*. Rotation of handle 118 in a first direction rotates body portion 118*a* such that body portion 118*a* is moved along shaft 116 toward first jaw member 110. Rotation of handle 118 in a second direction, opposite from the first direction, rotates body portion 118*a* such that body portion 118*a* is moved along shaft 116 away from first jaw member 110.

In operation, each jaw 98, 100 is adapted to engage respective side edges 120 of skis 96*a* and 96*b* for holding skis 96*a* and 96*b* in respective relatively fixed positions. Each ski 96*a*, 96*b* is preferably a snow ski having a beveled edging 124 on each side 120 adjacent a corresponding bottom surface 126 of the corresponding ski 96*a*, 96*b*. Beveled edgings 124 are typically made of a metal material, which is susceptible to damage when excessive pressure is exerted thereon.

The operation of vise 10 will be described with reference to one of the jaws 98. One skilled in the art will recognize that jaw 100 is operated in substantially the same manner to engage skis 96*a* and 96*b* at different locations on the skis 96*a* and 96*b*.

As can be best seen in FIG. 5B, one of the skis 96*a* is positioned between first jaw member 102 and second jaw member 103 and the other ski 96*b* is positioned between first jaw member 102 and third jaw member 104 such that skis 96*a* and 96*b* are in parallel relationship. First jaw member 102 includes a pair of resilient engagement members 128 on respective opposite sides of first jaw member 102. Second and third jaw members 103 and 104 each include a resilient engagement member 128. Skis 96*a* and 96*b* are positioned such that respective sides 120 of each ski 96*a*, 96*b* are in contact with corresponding engagement members 128. First and second jaw members 102 and 103 cooperate to hold ski 96*a* and first and third jaw members 102 and 104 cooperate to hold ski 96*b*.

First jaw member 102 includes a pair of recesses 130 on respective opposite sides of first jaw member 102. Each recess 130 is defined by a corresponding beveled surface 132. Similarly, second and third jaw members 103 and 104 each have a recess 130 defined by a corresponding beveled surface 132. Recesses 130 are configured to receive respective beveled edgings 124 such that beveled edgings 124 are not contacted by any portion of jaw members 102, 103 and 104, thereby protecting the surfaces of beveled edgings 124.

First jaw member 102 is stationary and second and third jaw members 103 and 104 are drawn toward first jaw member 102 by rotating handle 108 in the aforementioned first direction (e.g., in a clockwise direction for right handed screw threads). Rotation of handle 108 in the aforementioned first direction tightens the engagement between first and second jaw members 102 and 103 and ski 96*a*. Body portion 108*a* is positioned in abutting relation with second jaw member 103 such that body portion 108*a* serves as a locking device to secure jaw 103 in a fixed position on shaft 106. Continued rotation of handle 108 in the aforementioned first direction results in an axial movement of shaft 106, which draws third jaw member 104 toward first jaw member 102 and into pressure engagement with ski 96*a*. To disengage second and third jaw members 103 and 104, handle 108 is rotated in the aforementioned second direction, which releases second and third jaw members 103 and 104 to be moved away from first jaw member 102.

Figure 6A:
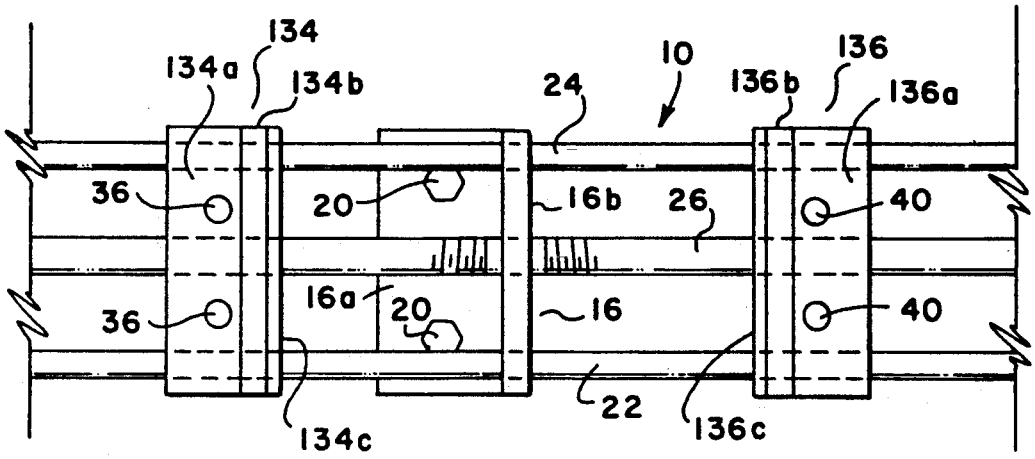
FIG. 6A and FIG. 6B are respective partial top plan and side elevation views of the vise of FIG. 1, equipped with a fifth set of jaws, illustrating the operation of the vise for retaining an object such as a water ski boot in a relatively fixed position.
Figure 6B:
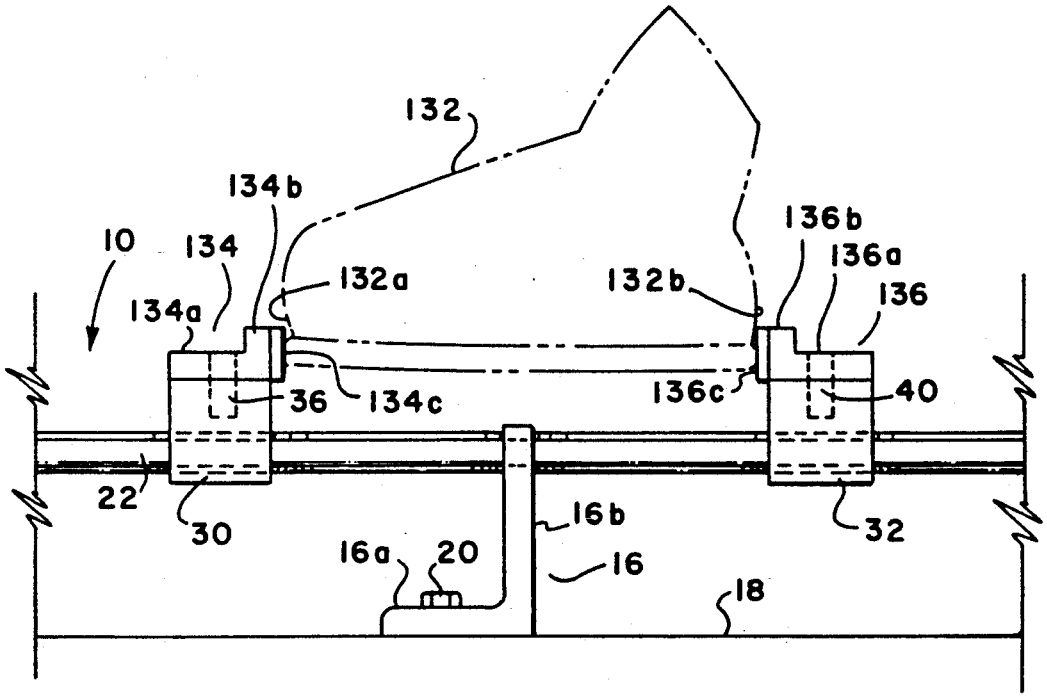

Referring to FIG. 6A and FIG. 6B, vise 10 is equipped with a fifth set of jaws for retaining a water ski boot 132 in a relatively fixed position. Jaws 134 and 136 are removably mounted on respective mounting members 30 and 32. Jaw 134 includes a base portion 134*a* having two bottom receptacles (not shown) for matingly receiving respective posts 36, whereby jaw 134 is removably mounted on mounting member 30. An upstanding portion 134*b* having a relatively flat front face 134*c* projects upwardly from base portion 134*a*. Jaw 136 includes a relatively flat base portion 136*a* having two bottom receptacles (not shown) for matingly receiving respective posts 40, whereby jaw 136 is removably mounted on mounting member 32. An upstanding portion 136*b* having a relatively flat front face 136*c* projects upwardly from base portion 136*a*.

Front faces 134*c* and 136*c* are adapted to engage respective toe and heel portions 132*a* and 132*b* of boot 132, which is typically used on a water ski for receiving a skier's foot. Jaws 134 and 136 are selectively movable into and out of engagement with boot 132 by the operation of handle 28 (see FIG. 1).

According to the present invention, a vise is provided which can accommodate jaws of various sizes and configurations, whereby the vise is adaptable for holding objects of various sizes and shapes. For example, the vise according to the present invention can be adapted, using modular jaw components, to engage the bindings or side edges of a snow ski, the top and bottom surfaces of a water ski, or various footwear, such as snow ski boots and water ski boots. Furthermore, as described above with reference to FIG. 5A and FIG. 5B, the side edges of the snow ski can be engaged without damaging the beveled metal edgings.

Although the invention has been described with reference to specific embodiments, the foregoing description is not intended to be construed in a limiting sense. Various modifications to the disclosed embodiment as well as alternative applications of the invention will be suggested to persons skilled in the art by the foregoing specification and by the drawings. It is therefore contemplated that the appended claims will cover any such modifications, applications or embodiments as fall within the true scope of the invention.

What is claimed is:

1. A vice for holding an object in a relatively fixed position, said vice comprising:

first and second mounting members;

first and second jaws carried on the respective first and second mounting members;

moving means for selectively moving said first and second mounting members and said first and second jaws into and out of engagement with the object;

each of said first and second jaws including a first jaw member, a second jaw member pivotally mounted with the corresponding second jaw member and a third jaw member attached to the corresponding second jaw member, the third jaw member of each of said first and second jaws being adapted to engage the object for holding the object in a relatively fixed position, the second and third jaw members of each of said first and second jaws being pivotable with respect to the corresponding first jaw member, whereby the object is rotatable between respective predetermined first and second positions, each of said first and second jaws further including securing means for releasably securing the corresponding second and third jaw members in respective fixed positions with respect to the corresponding first jaw member to secure the object in a predetermined fixed position.

2. A vice for holding a ski having relatively flat top and bottom surfaces and front and back retaining members located on the top surface for engaging respective toe and heel portions of ski footwear to retain the footwear in a relatively fixed position on the ski, said vice comprising:

first and second mounting members;

first and second jaws carried on the respective first and second mounting members;

moving means for selectively moving said first and second mounting members and said first and second jaws into and out of engagement with the object; and each of said first and second jaws including a first jaw member, a second jaw member pivotally mounted with the corresponding first jaw member and a third jaw member attached to the corresponding second jaw member, the third jaw member of each of said first and second jaws being adapted to engage a corresponding one of the retaining members for holding the ski in a relatively fixed position, the ski being moveable between a first position at which the top and bottom surfaces are oriented vertically and a second position at which the top and bottom surfaces are oriented laterally, each of said first and second jaws further including securing means for releasably securing the corresponding second and third jaw members in respective fixed positions with respect to the corresponding first jaw member to secure the ski in a predetermined fixed position.

3. A vice for holding a ski having relatively flat top and bottom surfaces and front and back retaining members located on the top surface for engaging respective toe and heel portions of ski footwear to retain the footwear in a relatively fixed position on the ski, said vice comprising:

support means mountable on a support surface;

a plurality of rods supported in spaced parallel relation by said support means, said plurality of rods including a rotatable rod having an external threaded surface;

first and second mounting members carried on said rods, each mounting member having a plurality of bores for accommodating the passage of the respective rods through the corresponding mounting member, said plurality of bores including a bore having an internal threaded surface which is complementary with said external threaded surface for engaging said external threaded surface, said mounting members being moveable in respective opposite directions along said rods in response to the rotation of said rotatable rod; and first and second jaws removably mounted on the respective first and second mounting members, said first and second jaws being selectively engageable with and disengageable from the ski, said first and second jaws being adapted to engage the respective front and back retaining members in pressure engagement for holding the ski in a relatively fixed position, each of said first and second jaws including a base member, a first jaw member removably mounted on the corresponding base member, a second jaw member pivotally attached to the corresponding first jaw member and a third jaw member attached to the corresponding second jaw member, the third jaw member of each of said first and second jaws being adapted to engage a corresponding one of the retaining members for holding the ski in a relatively fixed position, the ski being moveable between a first position at which the top and bottom surfaces are oriented vertically with respect to the support surface and a second position at which the top and bottom surfaces are oriented laterally with respect to the support surface, each of said first and second jaws further including securing means for releasably securing the corresponding second and third jaw members in respective fixed positions with respect to the corresponding first jaw member to secure the ski in a predetermined fixed position.

4. The vise of claim 3 further including manually operable means adjacent one end of said rotatable rod, to facilitate rotation of said rotatable rod.

5. The vise of claim 3 wherein said support means includes first and second support members which are spaced apart to define respective first and second opposite ends of the vise.

6. The vise of claim 5 further including a third support member intermediate said first and second support members, said third support member having a plurality of apertures for accommodating the passage of the respective rods through said third support member.

7. The vise of claim 6 wherein said first support member has an opening to accommodate the passage of said rotatable rod through said first support member, one end of said rotatable rod extending beyond said first end of said vise to define an extension portion of said rotatable rod, said vise further including manually operable means located on said extension portion, to facilitate the rotation of said rotatable rod.

8. The vise of claim 7 wherein said plurality of rods includes said rotatable rod and first and second fixed rods, said rotatable rod being intermediate said first and second fixed rods, said first and second fixed rods extending between said first and second support members, an opposite end of said rotatable rod being coterminous with said second end of said vise, said manually operable means being located on said extension portion.

9. The vise of claim 3 wherein each mounting member is adapted to accommodate a variety of jaws such that said vise is adaptable for holding objects of various sizes and shapes.

10. The vise of claim 9 wherein each mounting member has a relatively flat top surface and first and second posts projecting upwardly from the corresponding top surface, each jaw having a relatively flat bottom surface and first and second receptacles for matingly receive the respective first and second posts, each jaw being mountable on the corresponding mounting member such that the bottom surface of the corresponding jaw is in facing contact with the top surface of the corresponding mounting member.

11. The vise of claim 3 wherein the front and back retaining members have respective contoured recesses, respective leading ends of the third jaw members being contoured to conform to the respective contoured recesses such that the respective leading ends are matingly engageable with the respective contoured recesses.

* * * * *